United States Patent [19]

Lafferty et al.

[11] 4,043,716

[45] Aug. 23, 1977

[54] APPARATUS FOR PROVIDING A STREAM OF MOLTEN METAL FROM A METALLIC INGOT

[75] Inventors: William Daniel Lafferty; James Thomas Smith; Nicholas Wayne Rench, all of Towanda, Pa.

[73] Assignee: GTE Sylvania Incorporated, Stamford, Conn.

[21] Appl. No.: 637,761

[22] Filed: Dec. 4, 1975

[51] Int. Cl.[2] ..... B22D 23/08

[52] U.S. Cl. ..... 425/6; 425/174.8 R; 264/10

[58] Field of Search ..... 425/6, 10, 174.6, 174.8; 264/5, 10

[56] References Cited

U.S. PATENT DOCUMENTS

| | | | |
|---|---|---|---|
| 1,932,499 | 10/1933 | Woods | 425/10 |
| 2,712,621 | 7/1955 | North | 425/6 X |
| 2,790,019 | 4/1957 | Slatego | 425/6 X |
| 2,963,821 | 12/1960 | Baker | 425/6 X |
| 3,378,883 | 4/1968 | Lapple | 425/10 X |
| 3,726,621 | 4/1973 | Cichy | 425/6 |

*Primary Examiner*—Robert L. Spicer, Jr.
*Attorney, Agent, or Firm*—Norman J. O'Malley; John C. Fox; Lawrence R. Fraley

[57] ABSTRACT

An apparatus and method for providing a stream of molten metal from a metallic ingot wherein a quantity of the molten metal from the melted ingot is maintained at an established level within the chamber of the apparatus. It is further heated to an established temperature to then facilitate passage of the molten material through the apparatus's orifice.

11 Claims, 1 Drawing Figure

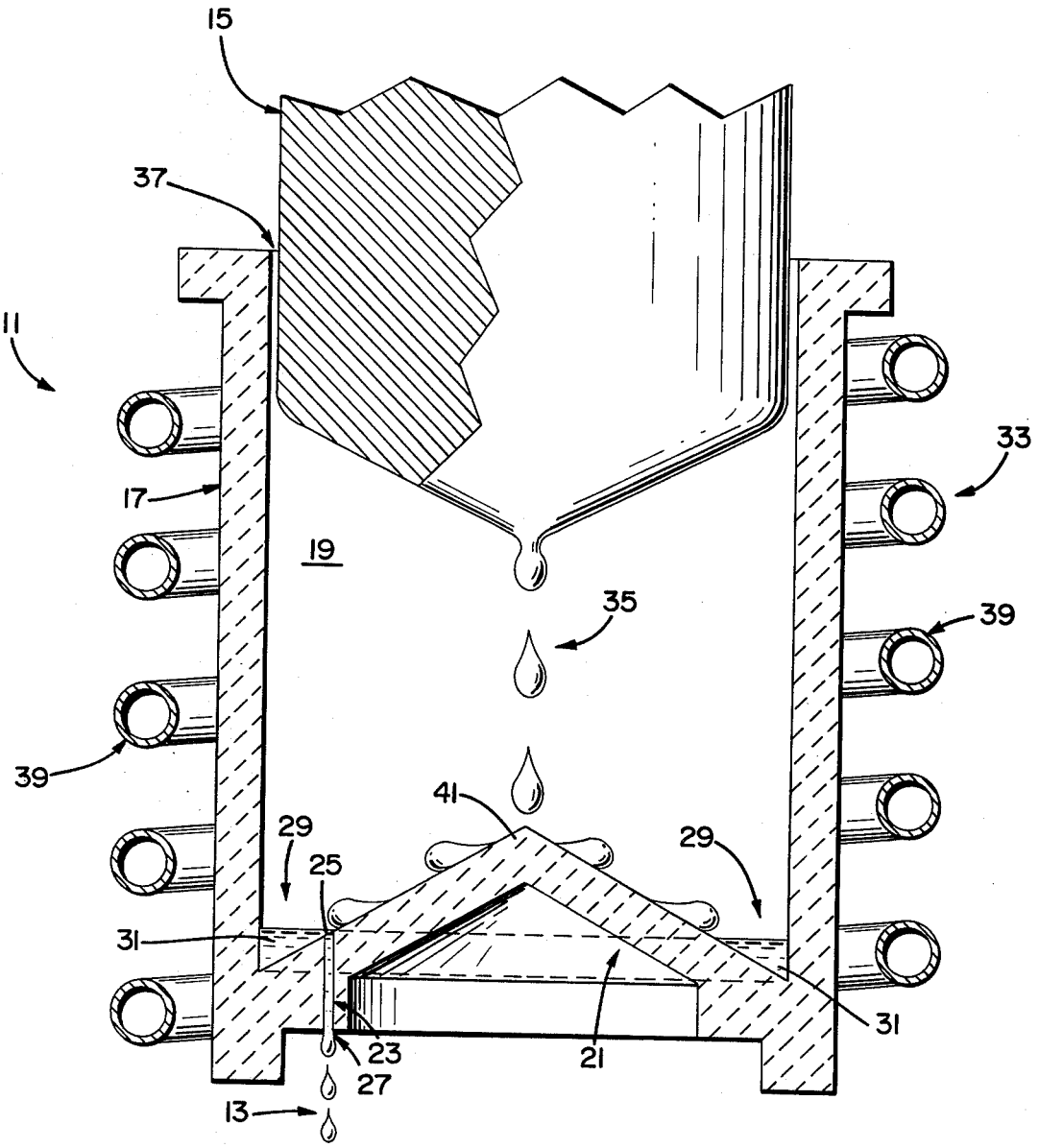
15
37
11
17
19
33
35
39
39
41
29
25
29
31
31
23
27
21
13

APPARATUS FOR PROVIDING A STREAM OF MOLTEN METAL FROM A METALLIC INGOT

BACKGROUND OF THE INVENTION

The present invention relates to the melting of metallic ingots. The invention further relates to melting metallic ingots and thereafter providing a stream of the molten metal from said ingots. Even further, the invention relates to melting processes of the variety described wherein the metallic ingots are superalloys.

Superalloys, particularly iron group metal based superalloys as defined in *The Encyclopedia of Chemical Technology,* Kirk-Othmer, 2nd Edition, Volume 11, pages 21–31, are finding an increasing use in the production of high hardness articles such as turbine fan blades, etc. Producing articles of this type usually involves a process wherein the superalloy metallic ingot is melted to form droplets with the droplets then being acted upon in an inert atmosphere to produce relatively fine powders. Such a technique involves pouring the molten stream of droplets onto a rotating disk within an atmosphere of argon or nitrogen. Still another technique involves utilizing a relatively high pressure jet of gas which atomizes the molten stream falling from a crucible or similar heating member.

A particular problem has resulted with regard to the above processes, that being an inconsistency in the sizes of the formed particles. As can be appreciated, a relatively wide distribution in particle sizes adversely affects the workability properties of such particles.

With particular regard to superalloys, still another problem has resulted, that being the tendency of the molten streams to pick up contaminants. Superalloys of the variety described are complex metal alloy systems often containing numerous reactive constituents such as zirconium, titanium, tungsten, and niobium. When in a molten state, they become especially reactive and tend to wet and erode the crucibles, containers, and other non-metallic components which they contact. In addition, the tendency to receive oxygen and similar contaminants is significantly increased. The eroded material from the mentioned manufacturing devices is often taken into the melt as a non-metallic inclusion which in turn weakens and may even cause failure in the produced parts. Such failure can result in destruction of the turbine engines and in the case of aircraft engines, cause fatal air crashes.

A known solution to the problem concerning inconsistent particle sizes is to use crucibles or similar melting devices which incorporate relatively small orifices or openings through which the molten metal will pass. Accordingly, when the molten stream engages the rotating component or is subjected to the pressurized jet of gas, the opportunity for uniform particle sizes is increased. To this date however, the known prior art has failed to provide a melting crucible member which could include small orifices therein. By small is meant orifices having diameters ranging from about 0.050 inches to about 0.100 inches. Known prior art crucibles require openings substantially larger in order to permit molten metal passage.

Regarding the problem of oxygen and non-metallic inclusions in the molten metal streams passing from the crucibles, the prior art has also failed to provide a crucible material able to prevent this. Some varieties of ceramic materials such as $Al_2O_3$ and MgO have been attempted, but the presence of the oxygen element therein has still resulted in a contaminated molten end product.

It is believed therefore that an apparatus and method for producing a molten stream from a metallic ingot wherein the stream is relatively free of contaminants such as oxygen and is passed from a crucible having an orifice or orifices therein substantially smaller than those of known prior art crucibles would constitute an advancement in the art.

OBJECTS AND SUMMARY OF THE INVENTION

It is therefore a primary objective of the present invention to enhance the art of melting metallic ingots.

It is a further object of the invention to provide an apparatus and method for melting metallic ingots which obviate several of the disadvantages of known prior art apparatus and methods.

In accordance with one aspect of the invention, the above objectives are achieved by providing an apparatus capable of providing a stream of molten metal from a metallic ingot heated to melting within the apparatus. The apparatus comprises a crucible member defining a chamber therein and including a lower base portion having at least one orifice therein, means within the crucible for maintaining a quantity of molten metal from the ingot at an established level within the chamber substantially below a first open end of said orifice, and a heating means positioned externally of the crucible for heating the metallic ingot sufficiently to melt said ingot at a pre-established rate and for heating the quantity of molten metal to an established temperature greater than the temperature of the ingot to facilitate passage of the molten metal through the orifice when the molten metal exceeds an established level within said chamber.

In accordance with another aspect of the invention, there is provided a method for providing a stream of molten metal from a metallic ingot utilizing an apparatus which includes a crucible member defining a chamber and having a lower base portion including therein at least one orifice, said method comprising the steps of: (a) introducing the ingot within the chamber of the crucible member; (b) heating the ingot to a temperature sufficient to melt the ingot at an established rate; (c) maintaining a quantity of molten metal at an established level within the chamber of the crucible below the orifice; and (d) heating said quantity of molten metal to an established temperature to facilitate passage of the molten metal through said orifice when the molten metal exceeds the established level within the chamber.

BRIEF DESCRIPTION OF THE DRAWING

The drawing represents an apparatus in accordance with a preferred embodiment of the present invention.

DESCRIPTION OF THE PREFERRED EMBODIMENTS

For a better understanding of the present invention, together with other and further objects, advantages and capabilities thereof, reference is made to the following disclosure and appended claims in connection with the above-described drawing.

With particular reference to the drawing, there is illustrated an apparatus 11 in accordance with a preferred embodiment of the present invention. Apparatus 11 is adapted for providing a stream of molten metal, illustrated as droplets 13, from a metallic ingot 15 heated to melting within apparatus 11. With regard to the invention, a stream is defined herein as comprising either a continuous or noncontinuous flow of molten metal.

Apparatus 11 comprises a substantially upright crucible member 17 defining a chamber 19 therein for receiving metallic ingot 15. Crucible member 17 includes a lower base portion 21 having at least one orifice 23 therein. Orifice 23 comprises a first open end 25 having access to chamber 19 and a second opposingly positioned open end 27 having access to the environment below crucible member 17.

Apparatus 11 further comprises means 29 within crucible member 17 for maintaining a quantity of molten metal 31 from ingot 15 at an established level within chamber 19. As indicated in the drawing, the level of molten metal 31 is established substantially below first open end 25 of orifice 23.

In the preferred embodiment of the invention, crucible 17 is substantially cylindrical in configuration and base portion 21 is similarly formed. It is understood, however, that the described preferred configurations are not limitive with regard to the present invention in that other configurations, including rectangular, could be successfully utilized.

Apparatus 11 further comprises heating means 33 positioned externally of crucible 11 for heating ingot 15 to a predetermined temperature sufficient to melt the ingot at a pre-established rate. This is illustrated in the drawings as melting the ingot sufficiently to provide a stream of molten metal 35 dropping from ingot 15. Heating means 33 is further adapted for heating the quantity of molten metal 31 within maintaining means 29 to an established temperature greater than that of the predetermined temperature of ingot 15 to facilitate passage of molten metal 31 through orifice 23 when the molten metal within means 29 exceeds the established level. As indicated, said level will be exceeded after a predetermined quantity of molten metal has fallen from ingot 15 and filled means 29 to overflowing, thereby necessitating passage of molten metal from crucible 17 in the form of stream 13.

In the preferred embodiment of the invention, crucible member 17 is comprised of boron nitride, said material being a non-oxide and therefore nonreactive to the metallic ingot when ingot 15 is of the preferred material heated by the present invention, that being a superalloy. When using boron nitride for crucible 17, the advantages previously cited for such a material are provided by the present invention. That is, the nitride crucible 17 will not melt and become included within the molten stream eventually passing from crucible 17. Furthermore, there is no oxygen element present within this material for contamination of the heated molten material which eventually would adversely affect the properties of said material.

Crucible 17 is also shown as comprising a substantially open upper end portion 37 adapted for having metallic ingot 15 pass therethrough. This also is not meant to be limitive with regard to the broad concept of the present invention in that another configuration for end 37 could be provided. The open end 37 is preferred however to facilitate introduction of ingot 15 in the manner shown. Introduction of ingot 15 is achieved by positive engagement of the ingot at an external location (not shown) and lowering the ingot at a predetermined rate within crucible 17.

Means 29 is preferably a recessed portion within lower base portion 21 of crucible 17 and is positioned substantially below first open end 25 of orifice 23. Accordingly, when the molten metal 31 within the recessed portion exceeds an established level, this material will overflow into orifice 23 and out of crucible 17. In the preferred embodiment of the invention, recessed portion 29 is positioned relative to and substantially about orifice 23. In the case of a cylindrical crucible 17, recessed portion 29 comprises a trough-like portion completely about the internal lower periphery of the crucible and the resulting orifice 23 is positioned internally of said surrounding trough-like or recessed portion. It is also understood with regard to the present invention that more than one orifice may be successfully utilized. That is, a plurality of such openings could be spacedly positioned about lower portion 21 substantially within the periphery defined by recessed portion 29. When using a single orifice 23 as illustrated in the drawing, it is preferred that said orifice have a diameter within the range of from about .050 inches to about .100 inches. Accordingly, it can be seen that the preferred embodiment of the invention as described and illustrated herein permits utilization of an orifice area of relatively small size. This provision constitutes still another significant feature with regard to the present invention.

The positioning relationship of recessed portion 29 relative to and substantially about orifice 23 represents one of the significant features of the present invention. This relationship provides a means whereby orifice 23 is continuously maintained at a substantially elevated temperature to in turn facilitate passage of molten material 31 therethrough. This feature is further achieved by providing a heating means 33 in the form of an electrically actuated induction coil 39 positioned substantially about crucible 17 in the manner shown. Accordingly, induction coil 39 creates an electro-magnetic field which, by induction, melts ingot 15 at a pre-established rate. The initial molten metal falling to the bottom of crucible 17 forms a continuous ring within maintaining means (recessed portion) 29. This continuous ring of molten metal now acts as a susceptor of the electromagnetic field in crucible 17. Accordingly, the electromagnetic field now heats the formed molten susceptor to a temperature substantially higher than that of ingot 15. In the embodiment illustrated, the heat generated from the molten susceptor is concentrated in the orifice area thereby heating orifice 23 and any subsequent metal therein. This desired feature permits utilization of the described substantially smaller orifices than crucibles of the known art. Furthermore, this feature provides a means whereby blockage of an orifice is substantially eliminated because the heated orifice prohibits the molten metal from freezing and thus blocking the orifice. This undesirable feature of many prior art heating apparatus resulted when chunks or significantly large portions of the melting ingot fell to the bottom of the crucible and substantially covered the exiting openings. This is prevented by the feature described in that should such enlarged members fall within recessed portion 29, the previously described higher temperatues would melt said members at an accelerated rate to maintain a continuous flow through orifice 23.

As further indicated in the drawings base portion 21 also includes an upstanding portion 41 of substantially conical configuration, said configuration extending above the first open end 25 of orifice 23. Such a configuration facilitates the flow of the molten metal falling from ingot 15 to eventual accumulation within recessed portion 29. This configuration is not meant to be limitive however with regard to the present invention but is preferred for the reasons stated.

Thus, there has been shown and described a preferred apparatus and method for providing a continuous and/or non-continuous stream of molten metal from a melted metallic ingot. The method as defined incorporates utilization of a crucible member defining a chamber therein and having a lower base portion, said lower base portion having at least one orifice therein. The method as described comprises firstly introducing a metallic ingot 15 within the chamber 19 of a crucible member 27. Thereafter, the metallic ingot is heated to a predetermined temperature sufficient to melt the ingot at an established rate. A quantity of molten metal 31 is maintained at an established level within the chamber 19 of crucible 17 below a first open end 25 of the crucible's orifice 23. By doing so, said quantity of molten metal is heated to an established temperature greater than the predetermined temperature of the ingot to in turn facilitate passage of said molten metal through orifice 23 when the molten metal exceeds the established level defined.

The method as described may be carried out in at least two known manners. Firstly, a gaseous atmosphere of practically any known gas may be introduced within chamber 19 during the heating of ingot 15. This gas preferably inert, would serve to reduce and substantially eliminate gaseous or similar impurities which may subsequently affect the molten stream. When the metallic ingot is subjected to such a gaseous atmosphere within chamber 19 and when utilizing the preferred materials listed, it is possible to heat the molten metal 31 within chamber 19 to a temperature range of from about 1300° Celsius to about 2200° Celsius. A preferred gas for introduction within chamber 19 during this process would be either argon or hydrogen. The rarer inert gases such as helium are also acceptable.

Still another embodiment of a method is known for achieving successful melting of ingot 15 within a crucible member. Said embodiment comprises subjecting the ingot to a vacuum with chamber 19 of crucible 17 during the heating of the ingot. Such an evacuated chamber would also substantially eliminate the possibility of any gaseous impurities affecting the resulting molten stream. When utilizing this embodiment of the invention, it is possible to heat the molten metal 31 within chamber 19 to a temperature within the range of from about 1300° Celsius to about 1700° Celsius.

Thus, there has been shown and described an apparatus and method for melting a metallic ingot and providing a stream therefrom. The invention as described permits utilization of substantially smaller orifices within the crucible of the heating apparatus thus providing a means whereby metal working of the resulting stream is facilitated. By using the preferred material described for the invention, a means is also provided whereby contamination of the molten stream is also substantially eliminated.

While there has been shown and described what are at present considered the preferred embodiments of the invention, it will be obvious to those skilled in the art that various changes and modifications may be made therein without departing from the scope of the invention as defined by the appended claims.

What is claimed is:

1. An apparatus for providing a stream of molten metal from a metallic ingot heated to melting within said apparatus, said apparatus comprising:

a substantially upright crucible member defining a chamber therein for receiving said metallic ingot and including a lower base portion having at least one orifice therein, said orifice including a first open end having access to said chamber and an opposing second open end having access to the environment below said crucible member;

means within said crucible member for maintaining a quantity of molten metal from said metallic ingot at an established level within said chamber substantially below said first open end of said orifice; and heating means positioned externally of said crucible member for heating said metallic ingot to a predetermined temperature sufficient to melt said ingot at a pre-established rate and for heating said quantity of molten metal within said maintaining means to an establishd temperature greater than said predetermined temperature of said ingot to facilitate passage of said molten metal through said orifice when said molten metal within said maintaining means exceeds said established level within said chamber.

2. The apparatus according to claim 1 wherein said crucible member is comprised of boron nitride.

3. The apparatus according to claim 2 wherein said metallic ingot is an iron group metal based superalloy.

4. The apparatus according to claim 1 wherein said crucible member includes a substantially open upper end portion, said upper end portion adapted for having said metallic ingot pass therethrough.

5. The apparatus according to claim 1 wherein said means for maintaining said molten metal at an established level comprises a recessed portion within said lower base portion of said crucible member, said recessed portion positioned substantially below said first open end of said orifice.

6. The apparatus according to claim 5 wherein said recessed portion is positioned relative to and substantially about said orifice.

7. The apparatus according to claim 5 wherein said base portion further includes an upstanding portion, said upstanding portion extending substantially above said first open end of said orifice.

8. The apparatus according to claim 7 wherein said upstanding portion is of substantially conical configuration.

9. The apparatus according to claim 1 wherein said heating means comprises an electrically actuated induction coil.

10. The apparatus according to claim 9 wherein said induction coil is positioned substantially about said crucible member.

11. The apparatus according to claim 1 wherein said orifice has a diameter within the range of from about 0.050 to about 0.100 inches.

* * * * *